US006931796B2

(12) United States Patent
Adriaansen et al.

(10) Patent No.: US 6,931,796 B2
(45) Date of Patent: Aug. 23, 2005

(54) EXTRUDED TRANSPARENT/TRANSLUCENT SHEET FOR ROOF STRUCTURES

(75) Inventors: Frans Adriaansen, Noord Brabant (NL); Chinniah Thiagarajan, Bangalore (IN); Jyotiba Baburao Suryawanshi, Bangalore (IN); Moitra Aniruddha, Bangalore (IN)

(73) Assignee: General Electric, Pittsfield, MA (US)

( * ) Notice: Subject to any disclaimer, the term of this patent is extended or adjusted under 35 U.S.C. 154(b) by 105 days.

(21) Appl. No.: 10/249,065

(22) Filed: Mar. 13, 2003

(65) Prior Publication Data

US 2004/0159054 A1 Aug. 19, 2004

Related U.S. Application Data

(60) Provisional application No. 60/319,943, filed on Feb. 13, 2003.

(51) Int. Cl.[7] ..... E04B 7/08
(52) U.S. Cl. ..... 52/81.1; 52/200; 52/537
(58) Field of Search ..... 52/81.1, 200, 253

(56) References Cited

U.S. PATENT DOCUMENTS

| | | | | |
|---|---|---|---|---|
| 4,117,638 A | * | 10/1978 | Kidd et al. | 52/200 |
| 4,573,300 A | | 3/1986 | Bezner | |
| 5,001,881 A | | 3/1991 | Boyd | 52/545 |
| 5,373,669 A | | 12/1994 | Paquette | 52/90.2 |
| 5,966,888 A | | 10/1999 | Richardson | |
| 5,972,475 A | | 10/1999 | Beekman | 428/167 |
| RE36,976 E | * | 12/2000 | Bezner | 52/563 |
| 6,164,024 A | * | 12/2000 | Konstantin | 52/200 |
| 6,729,674 B2 | * | 5/2004 | Davis et al. | 296/146.16 |

FOREIGN PATENT DOCUMENTS

| | | |
|---|---|---|
| DE | 1 925 744 | 11/1969 |
| DE | G 91 15 940.7 | 2/1992 |
| EP | 0 286 003 A1 | 3/1988 |
| EP | 0437810 | 7/1991 |
| EP | 0 530 545 B1 | 8/1992 |
| EP | 0 741 215 B1 | 11/1996 |
| EP | 1111153 A2 | 6/2001 |
| SE | CH690922 | 2/2001 |

OTHER PUBLICATIONS

Hawley's Condensed Chemical Dictionary, Lewis, 1997, John Wiley & Sons, 13, 896.*
PCT Search Report 03253023.0–2303 dated May 18, 2004.
DE 8709 349U—German patent without translation.

* cited by examiner

*Primary Examiner*—Carl D. Friedman
*Assistant Examiner*—Steve Varner

(57) ABSTRACT

An extruded, light-transmitting sheet structure includes a pair of outer walls separated apart from one another. At least one dome is formed as part of one of the pair of outer walls, and is disposed at a first outer edge of the structure. A rib structure is disposed between the pair of outer walls, wherein the rib structure includes at least one rib that extends into the dome.

13 Claims, 2 Drawing Sheets

EXTRUDED TRANSPARENT/TRANSLUCENT SHEET FOR ROOF STRUCTURES

CROSS REFERENCE TO RELATED APPLICATIONS

The present application claims the benefit of provisional application Ser. No. 60/319,943 filed Feb. 13, 2003.

BACKGROUND OF THE INVENTION

The present disclosure relates generally to extruded sheet structures and, more particularly, to an extruded transparent/translucent sheet suitable for roof structures.

Corrugated sheets of several types of materials are used for roof cladding structures. While many of these types of corrugated sheet materials are not light transmitting, it is sometimes desirable to receive natural daylight inside in commercial and residential buildings. Thus, at certain locations along a roof structure, the corrugated roof sheets or panels (e.g., metal sheets, glass fiber reinforced polyester, PVC) are replaced with transparent or translucent sheets. Typically, such transparent/translucent sheets are formed by extrusion of various types of thermoplastic resins such as polycarbonates. In fact, these extruded thermoplastic sheets are being used in an increasing range of commercial and residential applications, in view of the balance of light transmission, thermal insulation and strength properties of the sheets.

A further consideration in implementing thermoplastic sheets as a transparent/translucent roof material is the integration thereof with conventional, non-transparent roof panels. When used in a horizontal or slightly sloping installation, such as a skylight, or even in a vertical or steeply sloped installation, the sheets may be subjected to loads of snow and ice, or to wind and suction forces in several directions. Furthermore, there is also the issue of providing for relatively easy installation of the thermoplastic sheets between the non-transparent roof sheets. In order to maintain a consistent and attractive look, it is often preferable to provide the transparent sheet with the same or similar profile(s) as the non-transparent corrugated sheet.

Generally, however, existing thermoplastic sheet designs have not lent themselves to easy integration with conventional roof cladding panels while also maintaining certain strength and impact requirements. On one hand, those panel structures that incorporate features for both integration capability and strength are generally characterized by more complicated designs that often include additional mounting components such as springs or other supports. Such complicated designs are not easily and inexpensively made by an extrusion process. On the other hand, those panel designs that can be extruded do not provide the desired stiffness and impact strength.

BRIEF DESCRIPTIONS OF THE INVENTION

The above discussed and other drawbacks and deficiencies of the prior art are overcome or alleviated by an extruded, light-transmitting sheet structure. In an exemplary embodiment, the structure includes a pair of outer walls separated apart from one another. At least one dome is formed from as part of one of the pair of outer walls, and is disposed at a first outer edge of the structure. A rib structure is disposed between the pair of outer walls, wherein the rib structure includes at least one rib that extends into the dome.

In another aspect, a roof structure includes a light-transmitting panel disposed between a pair of non-transmitting panels. The light-transmitting panel further includes an extruded a pair of outer walls separated apart from one another, with at least one dome formed as part of one of the pair of outer walls, the dome being disposed at a first end of the light-transmitting panel. A rib structure is disposed between the pair of outer walls, the rib structure including a plurality of diagonally disposed ribs and vertically disposed ribs. The at least one dome includes at least one of the vertically disposed ribs extending therein.

BRIEF DESCRIPTION OF THE DRAWINGS

Referring to the exemplary drawings wherein like elements are numbered alike in the several Figures.

DETAILED DESCRIPTION OF THE INVENTION

Disclosed herein is a transparent/translucent sheet that can be easily installed as a roof panel in combination with existing non-transparent roof panels.

Figure 1:
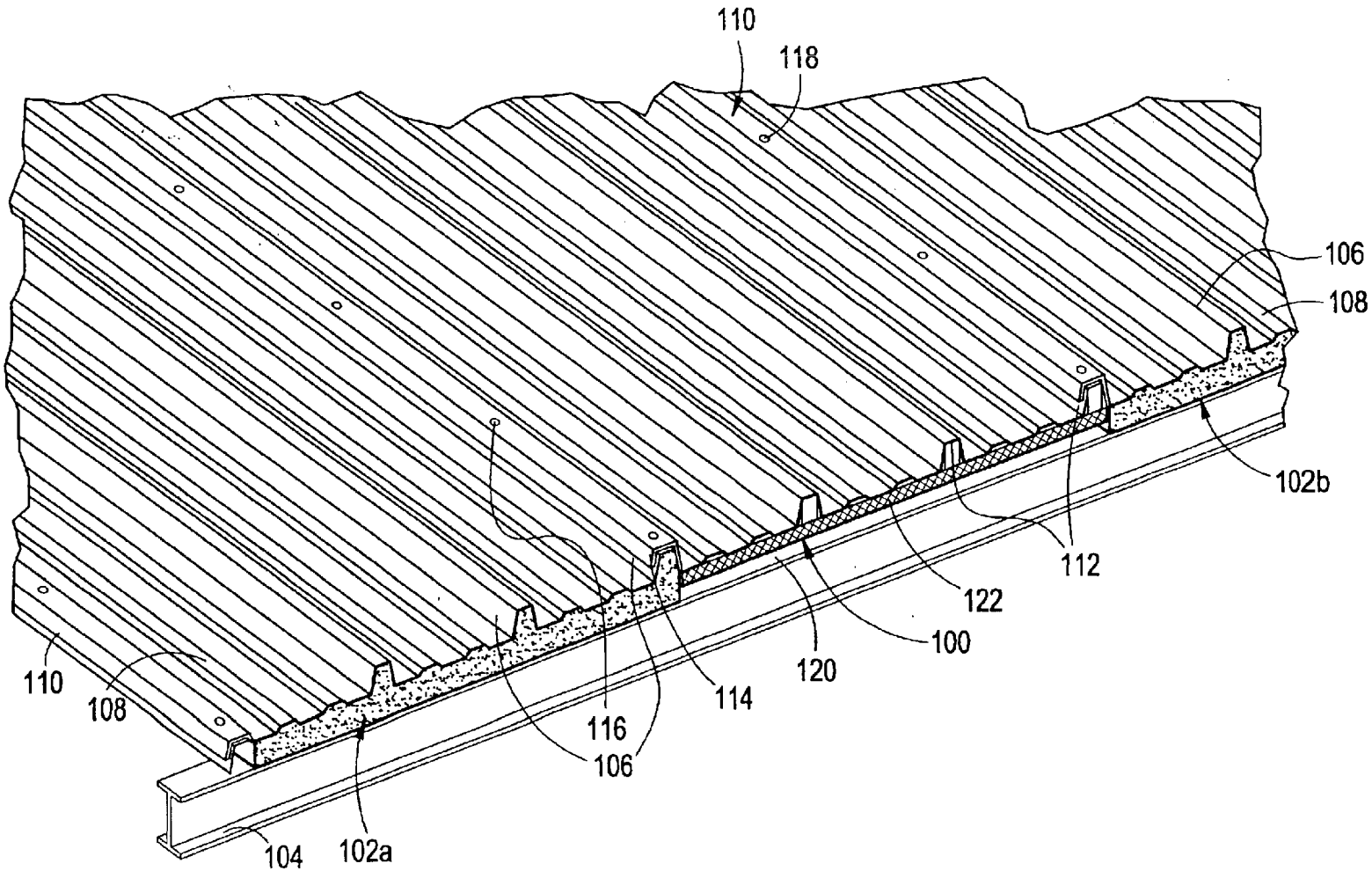
FIG. 1 is a perspective view of an extruded, light transmitting sheet, in accordance with an embodiment of the invention, shown mounted between a pair of non-transparent, corrugated roof panels.

Referring initially to FIG. 1, there is shown a perspective view of an extruded, light transmitting sheet 100 mounted between a pair of non-transparent, corrugated roof panels 102*a*, 102*b*. The extruded sheet 100 may be formed, for example, from a polycarbonate material or a poly methyl methacrylate (PMMA) material. A particularly suitable example includes the polycarbonate Lexan® by General Electric. The non-transparent roof panels 102*a*, 102*b* are each anchored upon a purlin 104 or other horizontal support member, as may be found in an exemplary roof support structure. It will be appreciated that the roof panels 102*a*, 102*b* may be formed from any conventional materials known in the art, such as from a pair of metal panels separated by a thermally insulated material. Other materials for the outer layer, such as glass fiber reinforced polyester or PVC, may also be used.

As can be seen from FIG. 1, each of the roof panels 102*a*, 102*b* has a profile along the outer or corrugated layer that features a plurality of trapezoidal shaped domes 106 running parallel to one another along the length of the sheet. Between each dome 106 is a pair of ridges 108 that also run parallel along the length of the sheet. In addition, the non-transparent panels 102*a*, 102*b* also include a trapezoidal shaped lip or wing 110 extending along one of the outer edges thereof for overlapping a dome of an adjacent panel, thus providing an interlocking fit therebetween.

In accordance with an embodiment of the present invention, the light transmitting (i.e., transparent or translucent) sheet 100 is formed so as to have a similar profile as that of the non-transparent metal insulated roof panels 102*a*, 102*b*. To this end, the extruded sheet 100 also features a plurality of trapezoidal shaped domes 112, as well as a trapezoidal wing 114. In this manner, the wing 114 of sheet 100 may be overlapped and attached to the end dome 106 of roof panel 102*a* by fasteners 116 such as self-tapping screws, for example. At the opposite end of sheet 100, the wing 110 of roof panel 102*b* is attached to the end dome 112 of sheet 100 by fasteners 118.

It will be noted that the overall thickness of the light-transmitting sheet 100 need not necessarily be as great as the thickness of the roof panels 102*a*, 102*b*, since the sheet is not directly mounted to the purlin 104. As is shown in the example of FIG. 1, the attachment of the sheet 100 directly to the roof panels 102*a*, 102*b* results in a gap 120 between the bottom of the sheet 100 and the purlin 104 in this instance. Although the gap 120 could be filled with an insulative or other supporting material, this need not be the case if material costs are of particular concern. On the other hand, if the thickness of the sheet 100 were about equivalent to that of the roof panels 102*a*, 102*b*, then the bottom of the sheet would abut the purlin 104.

In order to provide a desired stiffness and strength, the sheet 100 includes a multiple wall structure in which a web or rib structure 122 is provided between the outer walls of the sheet 100, and may include certain combinations of perpendicular (vertical) and diagonal ribs, as is discussed in further detail hereinafter with reference to FIGS. 2–4.

Figure 2:
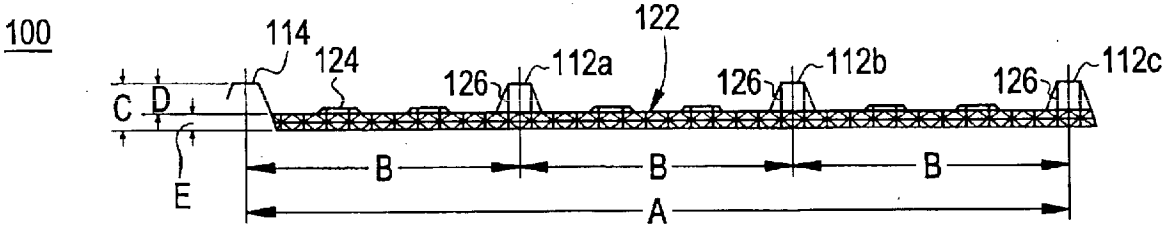
FIG. 2 is a cross sectional view of the extruded, light transmitting sheet in FIG. 1.

FIG. 2 is a cross sectional view of the extruded, light transmitting sheet 100, over the entire width thereof. The representative sheet 100 includes two central domes 112*a*, 112*b*, an end dome 112*c* at a first end of the sheet 100, and an overlapping trapezoidal shaped wing 114. However, a given sheet 100 may also be provided with a greater of lesser number of total domes than is shown in the figures. This is also the case for the smaller ridges 124 located between the domes and between dome 112*a* and the wing 114. FIG. 2 further illustrates exemplary dimensions for the sheet 100, wherein the reference letter "A" represents the distance between the center of wing 114 and end dome 112*c* (with "A" ranging from about 800 millimeters to about 1200 millimeters, for example). The reference letter "B" represents the distance between the centers of the domes as well as the distance between the center of dome 112*a* and the center of wing 114 (with "B" ranging from about 270 millimeters to about 400 millimeters, for example).

In addition, the reference letter "C" represents the total thickness or height of the panel 100 (with "C" ranging from about 50 millimeters to about 120 millimeters, for example); the reference letter "D" represents the height of the domes 112*a*, 112*b*, 112*c* and the wing 114 (with "D" ranging from about 30 millimeters to about 100 millimeters, for example); and the reference letter "E" represents the total thickness or height of the multiple walls of panel 100 (i.e., the total height "C" minus the dome height "D", with "E" ranging from about 15 millimeters to about 500 millimeters, for example.

In view of the above discussed problems relating to impact strength and ease of manufacture, FIG. 2 further illustrates the presence of vertical ribs 126 as part of the overall rib structure 122 and which extend up into the domes 112*a*, 112*b* and 112*c*. As is shown in greater detail in FIGS. 3 and 4, each dome includes a pair of vertical ribs 126 that are formed during the extrusion of the sheet 100, as are the other portions of the rib structure 122. As is the case with the number of domes included within the sheet 100, the number of vertical ribs extending into the domes may be varied, depending upon the particular application and structural requirements of the sheet 100. Although the vertical ribbing may be left out of one or more of the domes, the end dome 112*c* includes at least one rib 126 formed therein.

Figure 3:
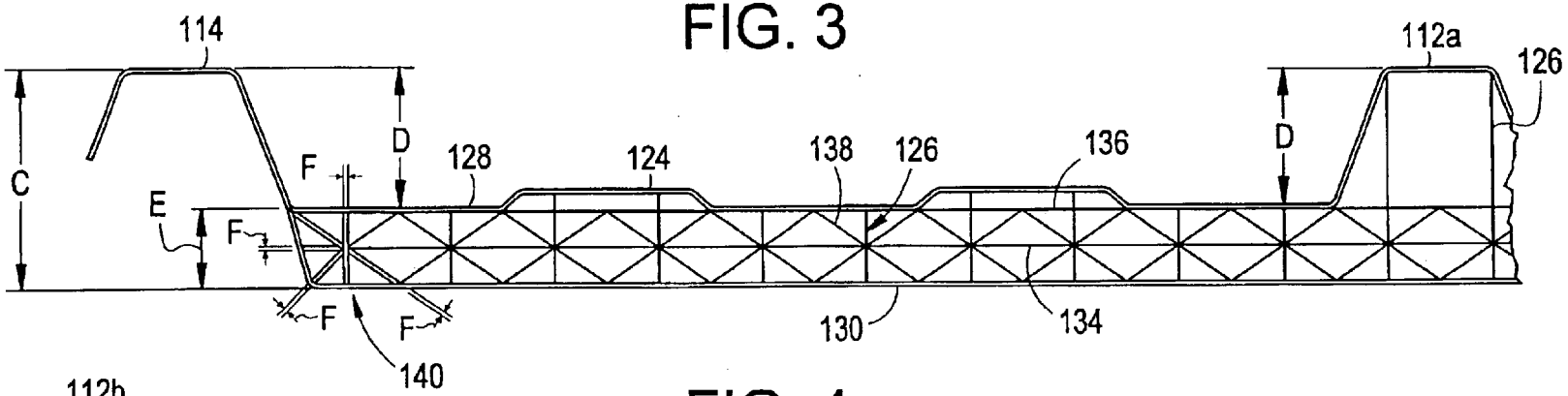
FIG. 3 is an enlarged cross sectional view of a portion of the sheet shown in FIG. 2.

FIG. 3 is an enlarged view of a portion of the sheet 100 shown in FIG. 2, particularly illustrating the subsection between the wing 114 and dome 112*a*. The arrangement of the rib structure 122 is shown in greater detail, being disposed between a pair of outer walls 128, 130. An interior wall 134 is disposed generally parallel to the outer wall 130 and to portions of the outer wall 128 not including the domes 112 or ridges 124. Thus, in a unitary extrusion process, the wing 114, ridges 124 and domes 112 are part of a continuous outer wall 130.

The rib structure 122 also includes a plurality of horizontal ribs 136 directly beneath the ridges 124 and domes 112, in addition to the vertical ribs 126. Furthermore, a plurality of diagonally disposed ribs 138 may also be configured in the rib structure 122 in a zigzag or X-shaped pattern as shown in the figures. It will be appreciated, however, that other diagonal rib configurations, such as V-shaped configurations for example, may also be possible so long as at least one of the domes includes at least one rib therein. However, the particular configuration of the at least one rib in the end dome 112*c* (or any other of the domes) need not necessarily be vertical (i.e., perpendicular with respect to the horizontal ribs 136. For example, there may also be diagonally disposed ribs (indicated by dashed lines 139) within the domes 112, in addition to or in lieu of the vertical ribs 126. Moreover, the ribs extending into any of the domes 12 may be located independent of the vertical ribs directly beneath the domes.

In accordance with a further aspect of the invention, the individual ribs proximate the wing 114 are fabricated at a greater thickness than those located in the interior portions of the sheet. For example, the horizontal, vertical and diagonal ribs (as well as the interior wall 134) may have a nominal thickness of about 0.1 millimeters (mm) to about 0.5 mm, in comparison to an inner and outer skin thickness of about 0.5 mm to about 1.5 mm. However, those ribs that are proximate the wing 114, shown generally at 140 and designated by reference letter "F" are formed at an increased thickness of about 0.3 mm to about 1.5 mm, comparable to that of the outer wall thickness. Such an adaptation provides additional rigidity and structural support without requiring the remaining portions of the web structure 122 to be fabricated at an undue thickness.

Figure 4:
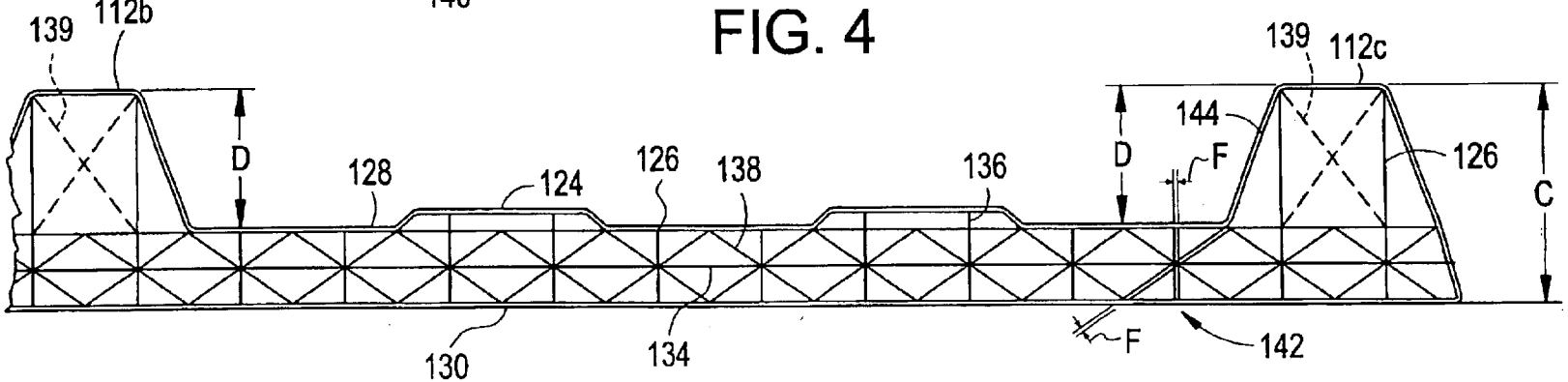
FIG. 4 is an enlarged cross sectional view of another portion of the sheet shown in FIG. 2.

Finally, FIG. 4 is an enlarged cross sectional view of another portion of the sheet 100 shown in FIG. 2, particularly illustrating the subsection between the dome 112*b* and dome 112*c*. From this view, it will be noted that the individual ribs (shown generally at 142) and proximate the inward wall 144 of dome 112*c* are also reinforced by being formed at the additional thickness, "F". The additional thickness of the ribs shown at 142 provide additional structural support, given that the end dome 112*c* is configured to receive the wing from an adjacent roof panel thereupon (e.g., the non-transparent panel 102*b* from FIG. 1).

It will thus be appreciated that the presence of the vertical ribs within the domes of the panel allow for the light-transmitting sheet to be manufactured by a relatively simple process, such as a unitary extrusion, while still maintaining desired structural and impact strength requirements. Moreover, by forming certain of the ribs at an additional thickness, an additional measure of reinforcement is provided such that the sheet can pass an impact test (e.g., withstanding the fall of a sand-filled bag of fifty kilograms from a height of 2.5 meters) without having to form the entire sheet at an undue thickness. The overall thickness of the light-transmitting panel is therefore independent of that of the non-transmitting panels.

This selective rib reinforcement also allows the direct attachment of a light-transmitting panel to adjacent non-transmitting roof panels by the overlapping fashion illustrated in FIG. 1, and without the need to directly secure the light-transmitting panel to a purlin or other roof support structure. In so doing, the structure also overcomes the problem of maintaining a relatively "hollow and freestanding" profile edge that can be made without a complicated extrusion tool, as opposed to the teachings of German Utility Model G 91 15 940.7 (filed Dec. 21, 1991).

In addition, one or more of the individual sheets shown in one or more of the embodiments may be provided with a coating layer thereon, depending upon the particular desired application thereof. For example, the polycarbonate material of the outer walls may be provided with an ultraviolet (UV) ray protective layer, an optical transmission enhancement layer, a self-cleaning layer or combinations thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An extruded, light-transmitting sheet structure, comprising:

a pair of outer walls separated apart from one another;

at least one dome formed as part of one of said pair of outer walls, said at least one dome disposed at a first outer edge of the structure;

a wing extending from a second edge of the structure, said wing having configuration so as to be able to overlap a dome of an adjacent sheet;

a rib structure disposed between said pair of outer walls, said rib structure further comprising a plurality of ribs, including diagonally disposed ribs and vertically disposed ribs, wherein said rib structure includes at least one of said vertically disposed ribs extending into said at least one dome; and wherein at least one rib adjacent said wing and at least one rib adjacent said at least one dome is formed at a thickness greater than the thickness of the remaining of said plurality of ribs.

2. The sheet structure of claim 1, wherein said at least one rib extending into said at least one dome comprises a vertically disposed rib.

3. The sheet structure of claim 1, wherein the structure further comprises a unitary extrusion.

4. The sheet structure of claim 1, wherein the structure is extruded from at least one of polycarbonate and a poly methyl methacrylate material.

5. The sheet structure of claim 4, wherein at least one of said pair of outer walls is provided with a coating layer thereupon.

6. The sheet structure of claim 5, wherein said coating layer comprises one of; an ultraviolet ray protective layer, an optical transmission enhancement layer, a self-cleaning layer, and combinations comprising at least one of the foregoing.

7. The sheet structure of claim 5, wherein said coating layer comprises one of; an ultraviolet ray protective layer, an optical transmission enhancement layer, a self-cleaning layer, and combinations comprising at least one of the foregoing.

8. A roof structure, comprising:

a light-transmitting panel disposed between a pair of non-transmitting panels, wherein said light-transmitting panel further comprises:

an extruded a pair of outer walls separated apart from one another;

at least one dome formed as part of one of said pair of outer walls, said at least one dome disposed at a first outer edge of said light-transmitting panel;

a wing extending from a second outer edge of said light-transmitting panel, said wing overlapping a dome of one of said non-transmitting panels adjacent said second end, said at least one dome of said light-transmitting panel is configured to receive a wing from the other of said non-transmitting panels adjacent said first end thereupon;

a rib structure disposed between said pair of outer walls, said rib structure including a plurality of diagonally disposed ribs and vertically disposed ribs, said at least one dome including at least one of said vertically and diagonally disposed ribs extending therein; and wherein at least one rib adjacent said wing of said light-transmitting panel and at least one rib adiacent said at least one dome of said light-transmitting panel is formed at a thickness greater than the thickness of the remaining of said plurality of ribs.

9. The roof structure of claim 8, wherein said light-transmitting panel is extruded from at least one of polycarbonate and a polymethyl methacrylate material.

10. The roof structure of claim 8, wherein said at least one dome and said wing of said light-transmitting panel are trapezoidal shaped.

11. The roof structure of claim 10, wherein:

said pair of non-transmitting panels are each affixed to a roof support member;

said wing extending from said second end of said light-transmitting panel is affixed to said dome of said non-transmitting panel adjacent said second end of said light-transmitting panel; and said at least one dome at said first end of said light-transmitting panel is affixed to said wing from said non-transmitting panel adjacent said end of said light-transmitting panel.

12. A roof structure of claim 8, wherein at least one of said pair of outer walls is provided with a coating layer thereupon.

13. The roof structure of claim 12, wherein said coating layer comprises one of: an ultraviolet ray protective layer, an optical transmission enhancement layer, a self-cleaning layer, and combinations comprising at least one of the foregoing.

* * * * *